US008956029B2

(12) United States Patent
Sekiguchi

(10) Patent No.: US 8,956,029 B2
(45) Date of Patent: Feb. 17, 2015

(54) VEHICLE LIGHTING UNIT

(71) Applicant: Stanley Electric Co., Ltd., Tokyo (JP)

(72) Inventor: Tatsuya Sekiguchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 29 days.

(21) Appl. No.: 13/846,803

(22) Filed: Mar. 18, 2013

(65) Prior Publication Data

US 2013/0250600 A1 Sep. 26, 2013

(30) Foreign Application Priority Data

Mar. 23, 2012 (JP) ..... 2012-067882
Mar. 23, 2012 (JP) ..... 2012-067883

(51) Int. Cl.
*F21S 8/10* (2006.01)

(52) U.S. Cl.
CPC ..... *F21S 48/145* (2013.01); *F21S 48/1388* (2013.01)
USPC ..... 362/538; 362/539

(58) Field of Classification Search
CPC ..... F21S 48/145
USPC ..... 362/538, 539
See application file for complete search history.

(56) References Cited

U.S. PATENT DOCUMENTS

2003/0189840 A1* 10/2003 Matsumoto et al. ..... 362/539
2007/0147062 A1* 6/2007 Nino et al. ..... 362/538
2007/0247865 A1* 10/2007 Kinoshita et al. ..... 362/538
2010/0002457 A1* 1/2010 Takada ..... 362/509
2011/0170308 A1* 7/2011 Kinoshita et al. ..... 362/516
2012/0287660 A1* 11/2012 Murakawa ..... 362/520

FOREIGN PATENT DOCUMENTS

JP 5-66807 U 9/1993

* cited by examiner

*Primary Examiner* — Laura Tso
(74) *Attorney, Agent, or Firm* — Kenealy Vaidya LLP

(57) ABSTRACT

A vehicle lighting unit can be capable of illuminating pedestrians and the like present in lateral areas above a horizontal line while suppressing generation of glare to oncoming or preceding vehicles. A vehicle lighting unit can also be capable of forming both a basic light distribution pattern and an overhead light distribution pattern without invading an area for reflecting light for forming a basic light distribution pattern. The vehicle lighting unit can include a projector lens disposed on an optical axis, a light source disposed behind a rear-side focal point of the projector lens, a reflecting surface configured to reflect light emitted from the light source so that the light is directed toward the optical axis, and a shade disposed between the projector lens and the light source. The shade can be configured to shield part of light emitted from the light source and reflected by the reflecting surface.

3 Claims, 8 Drawing Sheets

VEHICLE LIGHTING UNIT

This application claims the priority benefit under 35 U.S.C. §119 of Japanese Patent Applications No. 2012-067882 and No. 2012-067883 both filed on Mar. 21, 2012, which are hereby incorporated in their entireties by reference.

TECHNICAL FIELD

The presently disclosed subject matter relates to a vehicle lighting unit, and in particular, to a projector type vehicle lighting unit utilizing a shade.

BACKGROUND ART

In the field of vehicle lighting units, a so-called projector type vehicle lighting unit utilizing a shade have been conventionally proposed. (See, for example, Japanese Utility Model Application Laid-Open No. Hei. 5-66807.)

FIG. 1 is a vertical cross-sectional view showing a vehicle lighting unit 200 described in Japanese Utility Model Application Laid-Open No. Hei. 5-66807.

As shown in FIG. 1, the vehicle lighting unit 200 includes: a projector lens 210 disposed on its optical axis AX extending in the front-to-rear direction of a vehicle body, the projector lens 210 having a rear-side focal point F; a light source 220 disposed behind the rear-side focal point F of the projector lens 210; a reflecting surface 230 configured to reflect light emitted from the light source 220 forward so that the light is directed toward the optical axis AX; and a shade 240 disposed between the projector lens 210 and the light source 220, the shade 240 configured to shield part of the light emitted from the light source 220 and reflected by the reflecting surface 230, the part of the light assumed to be directed upward and pass through the projector lens 210 if it is not shielded.

The light source 220 is a bulb light source such as a halogen bulb. The reflecting surface 230 can be a revolved ellipsoid having a first focal point F1 disposed at or near (i.e., substantially at) the light source 220 and a second focal point F2 disposed at or near (i.e., substantially at) the rear-side focal point F of the projector lens 210. The shade 240 can be disposed between the projector lens 210 and the light source 220 such that the upper edge 241 is positioned at or near (i.e., substantially at) the rear-side focal point F of the projector lens 210.

In this vehicle lighting unit 200 with the above configuration, the light emitted from the light source 220 can be reflected by the reflecting surface 220 and converged at or near (i.e., substantially at) the rear-side focal point F of the projector lens while part of the light can be shielded by the shade. Specifically, the light directed upward and assumed to be travel through the projector lens 210 can be shielded by the shade 240. Then, the light not shielded by the shade 240 can be projected through the projector lens 210 forward to form a low-beam light distribution pattern P on a virtual vertical screen assumed to be present in front of the vehicle body about 25 m away from the vehicle body. In this case the low-beam light distribution pattern P can include a cut-off line CL defined by the upper edge 241 of the shade 240.

As discussed above, the vehicle lighting unit 200 with the above configuration can shield the upward light assumed to pass through the projector lens 210 with the shade 240, thereby preventing the generation of glare to oncoming vehicles or preceding vehicles. However, the vehicle lighting unit 200 with the above configuration may not illuminate the left and right lateral areas AL and AR above the horizontal line H-H with light as shown in FIG. 2. This may be a problem in which pedestrians, hindrances, and the like assumed to be present in the left and right lateral areas AL and AR may not be illuminated with light.

FIG. 3 is a vertical cross-sectional view showing another projector type vehicle lighting unit (vehicle headlamp) utilizing a shade as disclosed in Japanese Patent No. 3798723.

As shown in FIG. 3, the vehicle headlamp 200 described in Japanese Patent No. 3798723 can have the same basic structure as, or a structure similar to, the conventional vehicle lighting unit 200 shown in FIG. 1.

The difference therebetween is that the shade 240 has a through hole 242 in the upper edge thereof.

As in the previous conventional vehicle lighting unit 200 described above, the vehicle headlamp 200 with the above-described configuration can form a basic light distribution pattern (being a low-beam light distribution pattern) Pa including a cut-off line CL defined by the upper edge 241 of the shade 240 as shown in FIG. 4.

In addition to this, this vehicle headlamp 200 can form an overhead light distribution pattern Pb above the horizontal line H-H at the center area to illuminate an overhead sign area with light. Specifically, the overhead light distribution pattern Pb can be formed by reflecting part of light emitted from the light source 220 by a part 231 of the reflecting surface 230 positioned below the optical axis AX, allowing the reflected light to pass through the through hole 242 formed in the upper part of the shade 240, and then allowing the passing light to pass through the projector lens 210 to be directed forward and obliquely upward. (See FIG. 4.)

Therefore, the vehicle headlight 200 with the above configuration can form both the basic light distribution pattern Pa and the overhead light distribution pattern Pb. In this case, the part 231 of the reflecting surface 230 is used for reflecting light for forming the overhead light distribution pattern Pb. This means that the area to reflect light for forming the basic light distribution pattern Pa is invaded in part.

SUMMARY

The presently disclosed subject matter was devised in view of these and other problems and features and in association with the conventional art. According to an aspect of the presently disclosed subject matter, there is provided a vehicle lighting unit capable of illuminating pedestrians, hindrances and the like present in the left and right lateral areas above a horizontal line with light while suppressing the generation of glare to oncoming vehicles or preceding vehicles.

According to another aspect of the presently disclosed subject matter, there is provided a vehicle lighting unit capable of forming both the basic light distribution pattern and the overhead light distribution pattern without invading the area for reflecting light for forming the basic light distribution pattern.

According to still another aspect of the presently disclosed subject matter, a vehicle lighting unit having an optical axis extending in a front-to-rear direction of a vehicle body can include: a projector lens disposed on the optical axis and having a rear-side focal point; a light source disposed behind the rear-side focal point of the projector lens; a reflecting surface configured to reflect light emitted from the light source forward so that the light is directed toward the optical axis; and a shade disposed between the projector lens and the light source, the shade configured to shield part of the light emitted from the light source and reflected by the reflecting surface, the part of the light being assumed to be directed upward and pass through the projector lens if it is not shielded. This vehicle lighting unit is configured to form a low-beam light distribution pattern including a cut-off line defined by the shade. The vehicle lighting unit can be further configured such that the light source is configured to emit light in all possible directions around the light source as a center, and that the shade can include a shade main body having an upper edge disposed at or near (i.e., substantially at) the rear-side focal point of the projector lens and extending substantially horizontally along a focal point plane of the projector lens, and front extending portions extending from both horizontal end portions of the upper edge forward and obliquely downward, the front extending portions being configured to include, on respective upper surfaces thereof, front reflecting surfaces configured to reflect light emitted from the light source and entering the front reflecting surfaces forward so that the reflected light is allowed to pass through the projector lens and is used for illuminating left and right lateral areas above the horizontal line on a virtual vertical screen assumed to be in front of the vehicle body, thereby forming additional light distribution patterns to be added to the low-beam light distribution pattern.

In the vehicle lighting unit with the above configuration, the front reflecting surfaces extending from both the horizontal end portions of the upper edge of the shade main body forward and obliquely downward can reflect part of the light emitted from the light source in all directions and entering the front reflecting surfaces from all directions. This configuration can allow the reflected light to pass through the projector lens and to be used only for illuminating the left and right lateral areas above the horizontal line on the virtual vertical screen assumed to be in front of the vehicle body, thereby forming the additional light distribution patterns that do not include the area between the left and right lateral areas. Accordingly, the low-beam light distribution pattern can be formed to include the cut-off line defined by the shade (the upper edge of the shade) and the additional light distribution patterns. Incidentally, since no front reflecting surface is formed between the front extending portions (front reflecting surfaces on the left and right sides), the area between the left and right lateral areas may not be illuminated with light.

Specifically, the vehicle lighting unit with the above configuration can add the additional light distribution patterns only for illuminating the left and right lateral areas above the horizontal line and not to illuminate the area between the left and right lateral areas. The vehicle lighting unit is capable of illuminating pedestrians, hindrances and the like present in the left and right lateral areas above the horizontal line with light while suppressing the generation of glare to oncoming vehicles or preceding vehicles.

In the vehicle lighting unit with the above configuration, the shade can further include a rear extending portion extending from the upper edge rearward and obliquely downward, the rear extending portion being configured to include a rear reflecting surface on an upper surface thereof, the rear reflecting surface being configured to reflect light emitted from the light source and entering the rear reflecting surface forward so that the reflected light is allowed to pass through the projector lens.

In the vehicle lighting unit with the above configuration, the rear reflecting surface extending from the upper edge of the shade main body forward and obliquely downward can reflect part of the light emitted from the light source in all directions and entering the rear reflecting surface from all directions so that the reflected light is allowed to pass through the projector lens. Since the light projected forward can be used for illuminating the front area, the light utilization efficiency of the vehicle lighting unit can be enhanced.

According to another aspect of the presently disclosed subject matter, there is provided a vehicle lighting unit capable of illuminating pedestrians, hindrances and the like present in the left and right lateral areas above the horizontal line with light while suppressing the generation of glare to oncoming vehicles or preceding vehicles.

According to still another aspect of the presently disclosed subject matter, a vehicle lighting unit having an optical axis extending in a front-to-rear direction of a vehicle body can include: a projector lens disposed on the optical axis and having a rear-side focal point; a light source disposed behind the rear-side focal point of the projector lens; a reflecting surface configured to reflect light emitted from the light source forward so that the light is directed toward the optical axis; and a shade disposed between the projector lens and the light source, the shade configured to shield part of the light emitted from the light source and reflected by the reflecting surface, the part of the light being assumed to be directed upward and pass through the projector lens if it is not shielded. This vehicle lighting unit is configured to form a low-beam light distribution pattern including a cut-off line defined by the shade. The vehicle lighting unit can be further configured such that the light source is configured to emit light in all possible directions around the light source as a center, that the reflecting surface can include a basic reflecting area corresponding to an angular range of light incident on the projector lens and an extension reflecting area extending below and out of the area corresponding to the angular range, that the shade can include a shade main body having an upper edge disposed at or near (i.e., substantially at) the rear-side focal point of the projector lens and extending substantially horizontally along a focal point plane of the projector lens, and a rear extending portion extending from the upper edge rearward and obliquely downward, the rear extending portion being configured to include a rear reflecting surface on an upper surface thereof and an inner reflecting surface on a lower surface thereof, and that the shade main body can include a through hole formed in part of an upper end portion of the shade main body so that the light reflected by the extension reflecting area and further reflected by the inner reflecting surface can be allowed to pass therethrough. In this vehicle lighting unit, part of light emitted from the light source in all possible directions can enter and be reflected by the extension reflecting area and further reflected by the inner reflecting surface, and be allowed to pass through the through hole of the shade main body to be projected through the projector lens forward and obliquely upward so as to illuminate an overhead sign area on a virtual vertical screen assumed to be in front of the vehicle body, thereby forming an overhead light distribution pattern.

In the vehicle lighting unit with the above configuration, part of light emitted from the light source can be reflected not by the basic reflecting area (corresponding to the area for reflecting light for forming the basic light distribution pattern) but by the extension reflecting area extending below and out of the area corresponding to the angular range of light incident on the projector lens and the inner reflecting surface of the shade so that the part of the light can be reflected twice and allowed to pass through the through hole formed in the upper end portion of the shade to be projected through the projector lens forward and obliquely upward so as to illuminate the overhead sign area on the virtual vertical screen assumed to be in front of the vehicle body, thereby forming the overhead light distribution pattern. This can allow a vehicle lighting unit to form both the basic light distribution pattern and the overhead light distribution pattern without invading the area for reflecting light for forming the basic light distribution pattern.

In the vehicle lighting unit with the above configuration, the shade can further include front extending portions extending from both horizontal end portions of the upper edge forward and obliquely downward, the front extending portions being configured to include, on respective upper surfaces thereof, front reflecting surfaces configured to reflect the light emitted from the light source and entering the front reflecting surfaces forward so that the reflected light is allowed to pass through the projector lens and is used for illuminating left and right lateral areas above the horizontal line on the virtual vertical screen assumed to be in front of the vehicle body, thereby forming additional light distribution patterns to be added to the basic light distribution pattern.

In the vehicle lighting unit with the above configuration, the front reflecting surfaces extending from both the horizontal end portions of the upper edge of the shade main body forward and obliquely downward can reflect part of the light emitted from the light source in all directions and entering the front reflecting surfaces from all directions. This configuration can allow the reflected light to pass through the projector lens and to be used only for illuminating the left and right lateral areas above the horizontal line on the virtual vertical screen assumed to be in front of the vehicle body, thereby forming the additional light distribution patterns that do not include the area between the left and right lateral areas. Accordingly, the basic light distribution pattern can be formed to include the cut-off line defined by the shade (the upper edge of the shade) and the additional light distribution patterns. Incidentally, since no front reflecting surface is formed between the front extending portions (front reflecting surfaces on the left and right sides), the area between the left and right lateral areas may not be illuminated with light.

Specifically, the vehicle lighting unit with the above configuration can add the additional light distribution patterns only for illuminating the left and right lateral areas above the horizontal line and not to illuminate the area between the left and right lateral areas, the vehicle lighting unit is capable of illuminating pedestrians, hindrances and the like present in the left and right lateral areas above the horizontal line with light while suppressing the generation of glare to oncoming vehicles or preceding vehicles.

According to the presently disclosed subject matter, there is provided the vehicle lighting unit capable of forming both the basic light distribution pattern and the overhead light distribution pattern without invading the area for reflecting light for forming the basic light distribution pattern.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to a vehicle lighting unit 10 (or vehicle headlamp) of the presently disclosed subject matter with reference to the accompanying drawings in accordance with exemplary embodiments.

Note that the directions defined in the present specification means the directions including front (forward), rear (rearward, backward), left, right, up (upper, upward) and down (lower, downward) may be considered on the basis of the case where the vehicle lighting unit is mounted on a vehicle body as a vehicle headlamp in a normal condition, unless otherwise specified.

Figure 1:
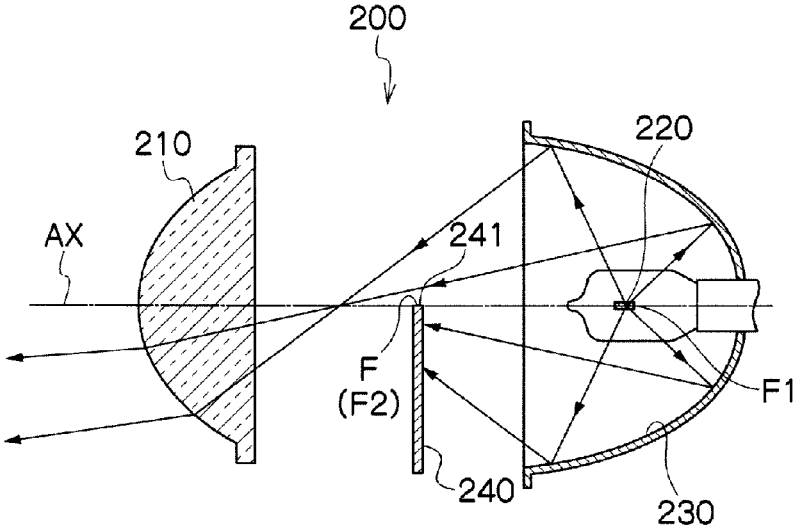
Fig. 1 Conventional Art
FIG. 1 is a vertical cross-sectional view showing a conventional vehicle lighting unit.
Figure 2:
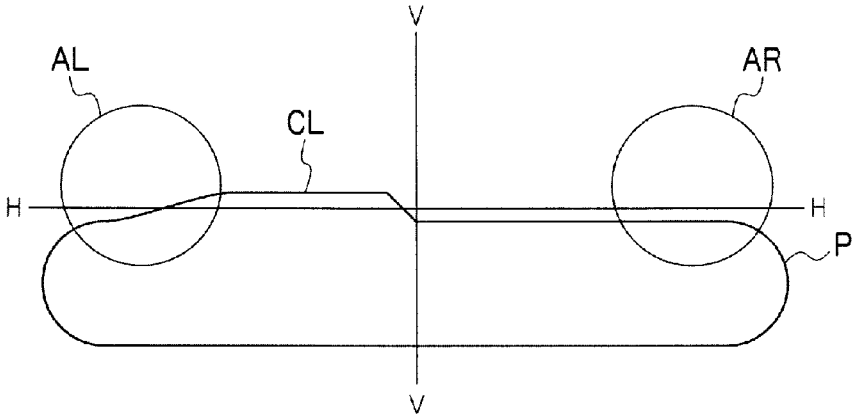
Fig. 2 Conventional Art
FIG. 2 is an exemplary low-beam light distribution pattern formed by the conventional vehicle lighting unit of FIG. 1.
Figure 3:
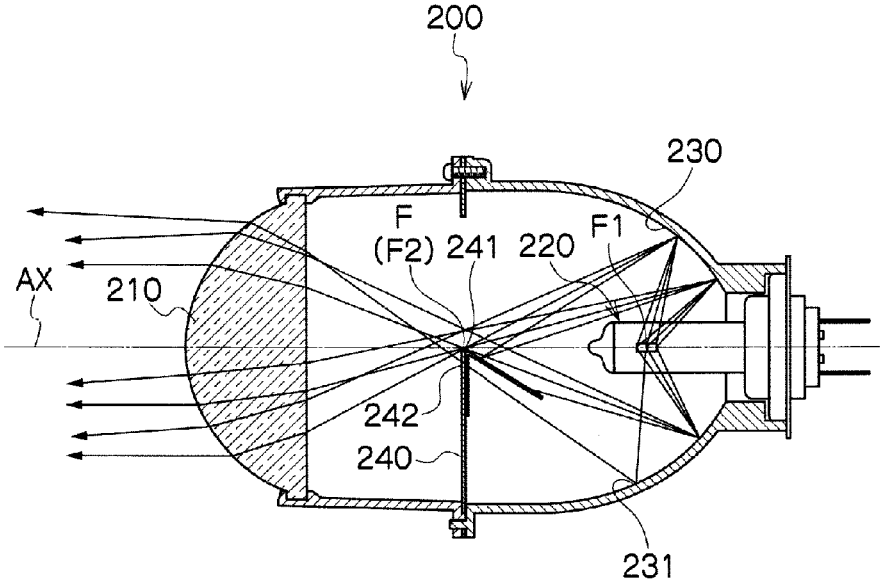
Fig. 3 Conventional Art
FIG. 3 is a vertical cross-sectional view showing another conventional vehicle lighting unit.
Figure 4:
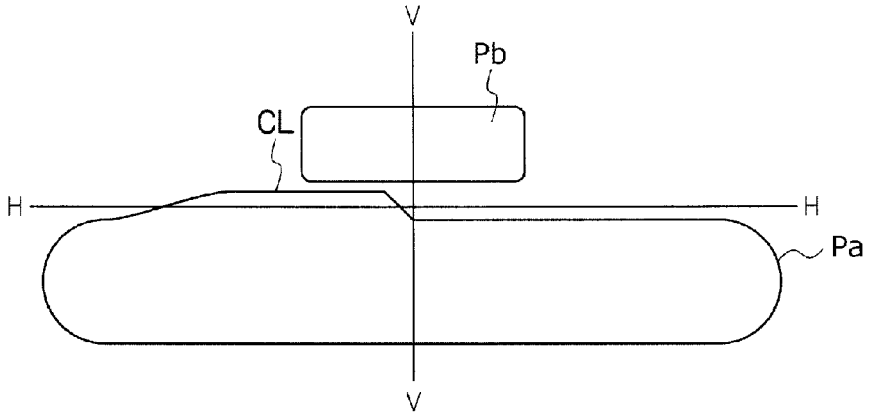
Fig. 4 Conventional Art
FIG. 4 is a diagram showing an exemplary low-beam light distribution pattern formed by the conventional vehicle lighting unit of FIG. 3.
Figure 5:
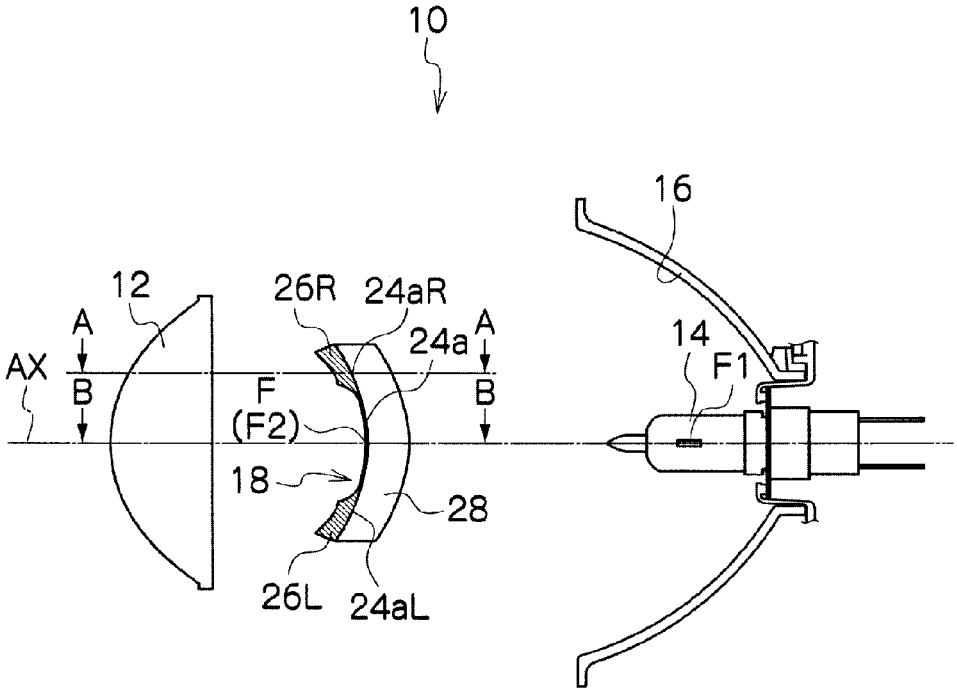
FIG. 5 is a horizontal cross-sectional view including its optical axis, showing a vehicle lighting unit made in accordance with principles of the presently disclosed subject matter.
Figure 6A:
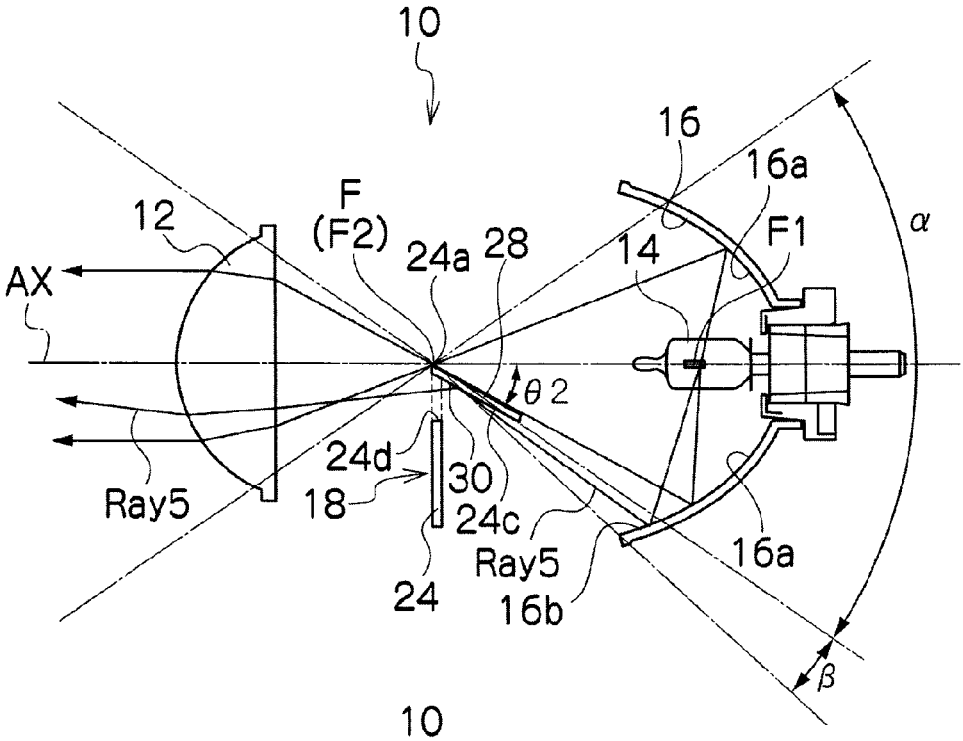
FIG. 6A is a cross-sectional view of the vehicle lighting unit of FIG. 5 taken along a vertical plane including its optical axis.
Figure 6B:
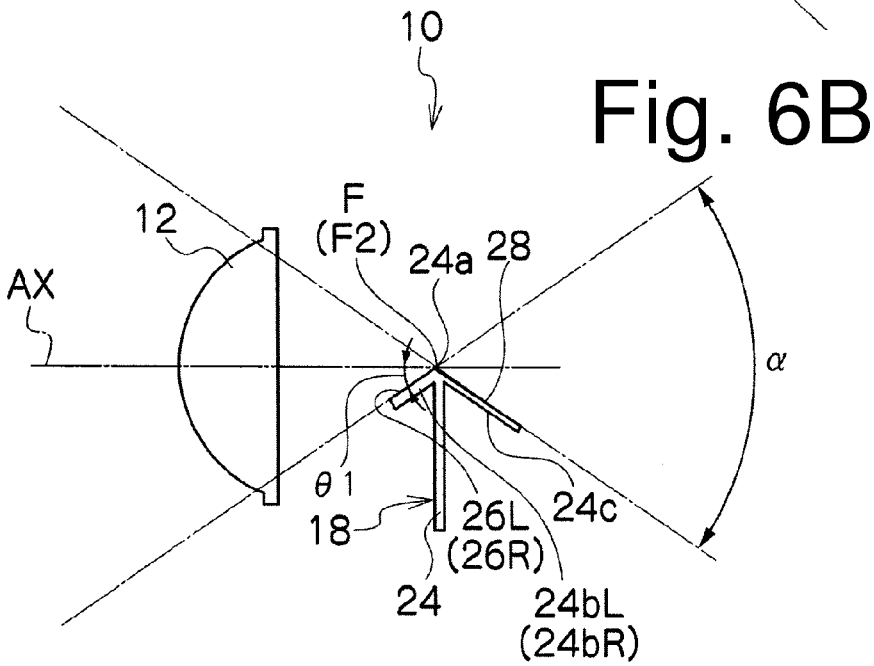
FIG. 6B is a cross-sectional view of the vehicle lighting unit of FIG. 5 taken along line A-A.
Figure 7:
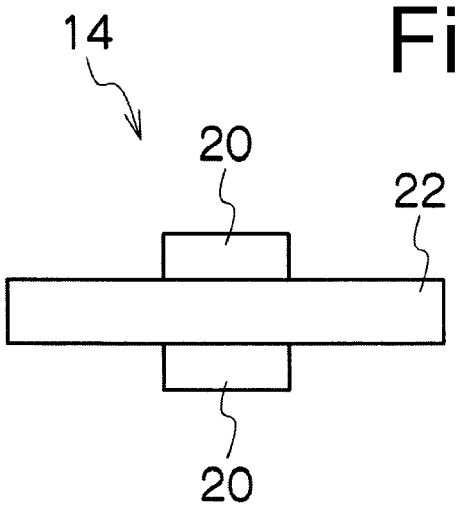
FIG. 7 is a front view of an exemplary light source.
Figure 8:
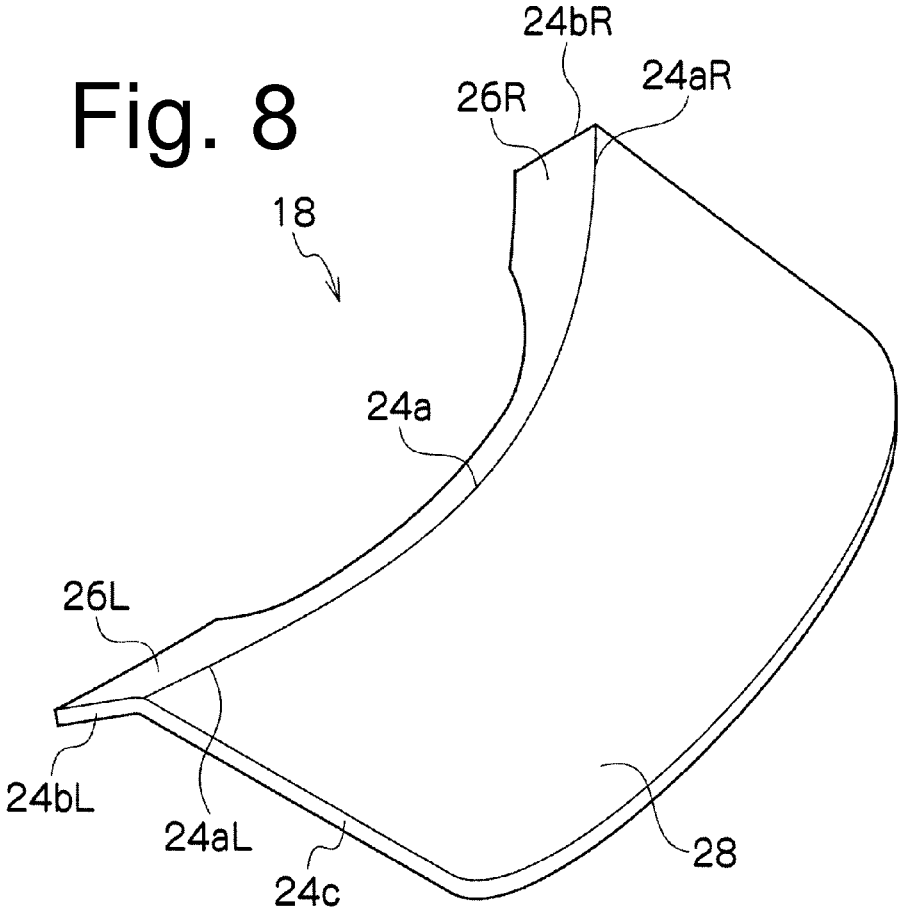
FIG. 8 is a perspective view showing front reflecting surfaces and a rear reflecting surface of a shade.
Figure 9:
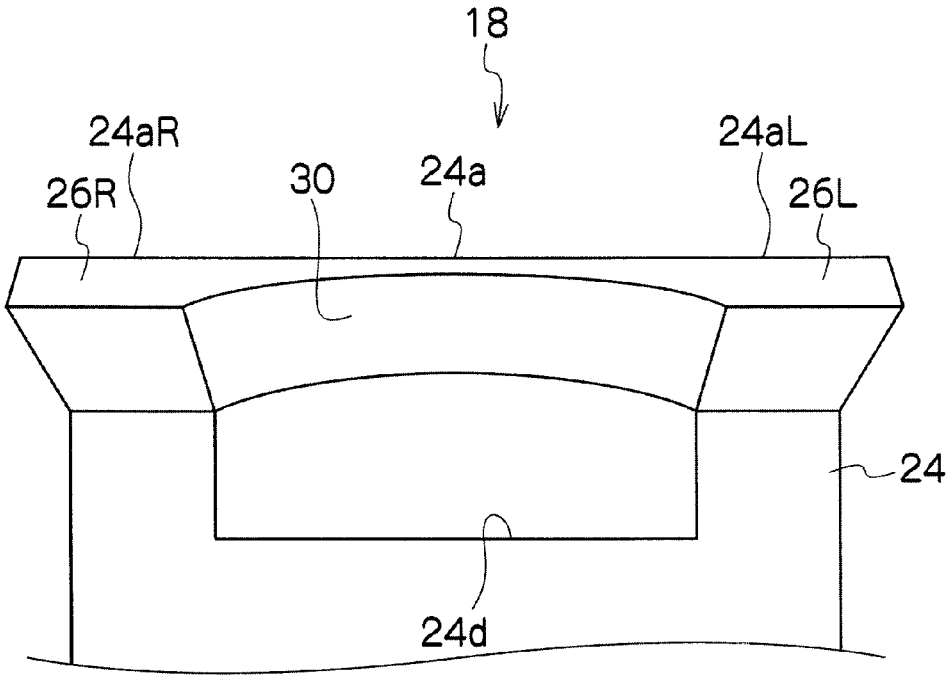
FIG. 9 is a front view of the shade.
Figure 10A:
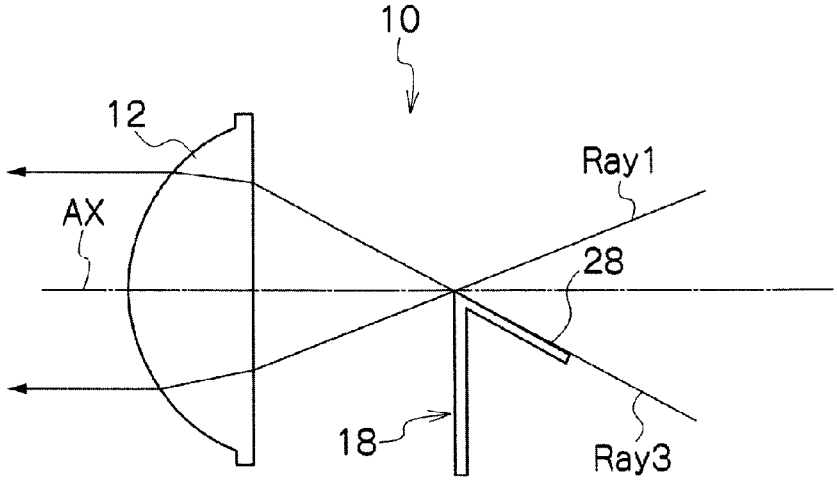
FIG. 10A is a cross-sectional view of the vehicle lighting unit of FIG. 5 taken along line B-B.
Figure 10B:
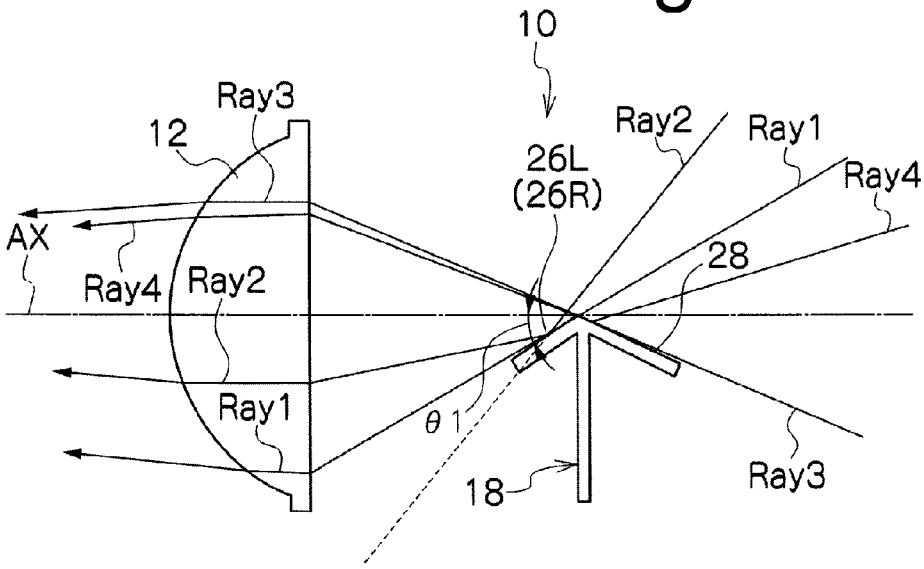
FIG. 10B is a cross-sectional view of the vehicle lighting unit of FIG. 5 taken along line A-A.
Figure 11:
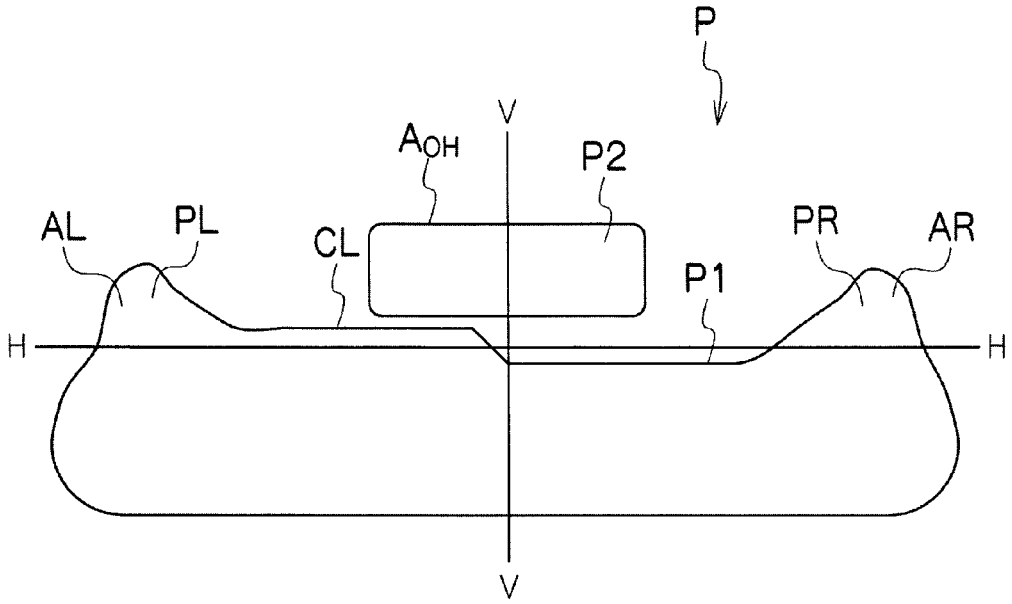
FIG. 11 is a diagram showing exemplary light distribution patterns formed by the vehicle lighting unit of FIG. 5.

FIG. 5 is a horizontal cross-sectional view including its optical axis AX, showing a vehicle lighting unit 10 made in accordance with principles of the presently disclosed subject matter; FIG. 6A is a cross-sectional view of the vehicle lighting unit 10 of FIG. 5 taken along a vertical plane including its optical axis AX, and FIG. 6B is a cross-sectional view of the vehicle lighting unit 10 of FIG. 5 taken along line A-A; FIG. 7 is a front view of an exemplary light source 14; FIG. 8 is a perspective view showing front reflecting surfaces 26L and 26R and a rear reflecting surface 28 of a shade 18; FIG. 9 is a front view of the shade 18; FIG. 10A is a cross-sectional view of the vehicle lighting unit 10 of FIG. 5 taken along line B-B, and FIG. 10B is a cross-sectional view of the vehicle lighting unit 10 of FIG. 5 taken along line A-A; and FIG. 11 is a diagram showing exemplary light distribution patterns P1 and P2 formed by the vehicle lighting unit 10 of FIG. 5.

As shown in FIGS. 5, 6A and 6B, the vehicle lighting unit 10 made in accordance with the principles of the presently disclosed subject matter can be a projector type lighting unit configured to form a low-beam light distribution pattern. The vehicle lighting unit 10 can include the optical axis AX extending in the front-to-rear direction of a vehicle body. The vehicle lighting unit 200 can include: a projector lens 12 disposed on the optical axis AX, the projector lens 12 having a rear-side focal point F; a light source 14 disposed behind the rear-side focal point F of the projector lens 12; a reflecting surface 16 configured to reflect light emitted from the light source 14 forward so that the light is directed toward the optical axis AX; a shade 18 disposed between the projector lens 12 and the light source 14, the shade 18 configured to shield part of the light emitted from the light source 14 and reflected by the reflecting surface 16, the part of the light assumed to be directed upward and pass through the projector lens 12 if it is not shielded.

The projector lens 12 can be a plano-convex lens having a front convex surface and a rear flat surface, and supported by a holder (not shown) so as to be disposed on the optical axis AX; and other components not illustrated.

The light source 14 can be configured to emit light in all possible directions around the light source as a center, and examples thereof may include a halogen bulb, an HID bulb, a semiconductor light emitting element, and the like. Note that any structure can be adopted to the light source 14 as long as the light source can emit light in all possible directions from light source as the center. FIG. 7 shows one example of such a light source 14. The exemplary light source can include two light source elements 20 each utilizing a semiconductor light emitting element configured to emit light in all directions within the hemispherical region. Here, the two light source elements 20 are disposed on a substrate 22, which is interposed between the rear surfaces of the light source elements 20. Examples of the semiconductor light emitting element can be a light emitting diode (LED), a laser diode (LD), and the like. Specific examples thereof may include a white light source composed of an LED and a wavelength conversion material (such as phosphor) in combination, and a white light source composed of an LED and a wavelength conversion material (such as phosphor) in combination.

The reflecting surface 16 can be a revolved ellipsoid or free curved reflecting surface having a first focal point F1 disposed at or near (i.e., substantially at) the light source 14 and a second focal point F2 disposed at or near (i.e., substantially at) the rear-side focal point F of the projector lens 12.

As shown in FIG. 6A, the reflecting surface 15 can include a basic reflecting area 16*a* corresponding to an angular range α of light incident on the projector lens 12 and an extension reflecting area 16*b* extending below and out of the area 16*a* corresponding to the angular range α (or an extension reflecting area 16*b* corresponding to the angular range β). Note that the angular range α of light incident on the projector lens 12 can be an angle formed between two straight lines connecting the focal point F of the projector lens 12 to both radial effective ends of the projector lens 12 (effective diameter).

As shown in FIGS. 5, 6A, 6B, 8, and 9, the shade 18 can include a shade main body 24 having an upper edge 24*a*, front extending portions 24*b*L and 24*b*R extending from both horizontal end portions 24*a*L and 24*a*R of the upper edge 24*a* forward and obliquely downward, and a rear extending portion 24*c* extending from the upper edge 24*a* rearward and obliquely downward. The upper edge 24*a* can be disposed at or near (i.e., substantially at) the rear-side focal point F of the projector lens 12 and extend substantially horizontally along a focal point plane of the projector lens 12 while there is a step between the right side and the left side for forming a cut-off line CL. The front extending portions 24*b*L and 24*b*R can be configured to include, on respective upper surfaces thereof, front reflecting surfaces 26L and 26R. The rear extending portion 24*c* can be configured to include a rear reflecting surface 28 on an upper surface thereof and an inner reflecting surface 30 on a lower surface thereof. The shade main body 24 can include a through hole 24*d* formed in part of an upper end portion of the shade main body 24 so that the light reflected by the extension reflecting area 16*b* of the reflecting surface 16 and further reflected by the inner reflecting surface 30 can be allowed to pass therethrough. (See FIG. 6A and FIG. 9.)

The front reflecting surfaces 26L and 26R can have a straight vertical cross section (see FIG. 6B) and a curved horizontal cross section along the upper edge 24*a* (see FIG. 5 and FIG. 8). The front reflecting surfaces 26L and 26R can be formed by subjecting the upper surfaces of the front extending portions 24*b*L and 24*b*R of the shade 18, which extend from both the horizontal end portions 24*a*L and 24*a*R of the upper edge 24*a* forward and obliquely downward, to mirror finishing or metal deposition such as aluminum deposition. Alternatively, a thin reflective plate can be pasted onto the upper surface of each of the front extending portions 24*b*L and 24*b*R of the shade 18. Note that the front reflecting surfaces 26L and 26R can have a curved vertical cross section other than the straight vertical cross section. The shape and/or dimension of the vertical cross section and/or the horizontal cross section of the front reflecting surfaces 26L and 26R can be adjusted to adjust the vertical dimension and/or horizontal dimension of the additional light distribution patterns PL and PR above the horizontal line H-H for illuminating the left and right lateral areas AL and AR with light.

As shown in FIG. 6B, the inclination angle θ1 of the front reflecting surfaces 26L and 26R with respect to the horizontal plane can be set to an angle of α/2 or larger (where α represents the angular range α of light incident on the projector lens 12 as defined above) in order not to hinder the traveling path of light emitted from the light source 14 in all directions and incident on the projector lens 12 (see the light Ray1 in FIGS. 10A and 10B, which is the light reflected by part of the basic reflecting area 16*a* above the optical axis AX). Specifically, the front reflecting surfaces 26L and 26R can be configured to extend forward and obliquely downward in an area below and out of the area corresponding to the angular range α of the light incident on the projector lens 12.

In the vehicle lighting unit 10 with the above configuration, the light emitted from the light source 14 in all possible directions may include light incident on the front reflecting surfaces 26L and 26R from all possible directions, for example, the light Ray2 reflected by the basic reflecting area 16*a* above the optical axis AX and incident on the front reflecting surfaces 26L and 26R with a relatively large incident angle. This light Ray2 can be reflected by the front reflecting surfaces 26L and 26R and pass through the projector lens 12, so as to be used for illuminating the left and right lateral areas AL and AR above the horizontal line H-H on a virtual vertical screen assumed to be in front of the vehicle body, thereby forming the additional light distribution patterns PL and PR. The vertical dimension of the additional light distribution patterns PL and PR can also be adjusted by adjusting the length in the forward direction of the front reflecting surfaces 26L and 26R and/or the inclination angle θ1 of the front reflecting surfaces 26L and 26R with respect to the horizontal plane. Further, the horizontal dimension of the additional light distribution patterns PL and PR can also be adjusted by adjusting the horizontal dimension of the front reflecting surfaces 26L and 26R.

The front reflecting surfaces 26L and 26R can be provided in areas so that the additional light distribution patterns PL and PR are positioned outside the angular area of ±9 degrees in the right and left directions above the horizontal line H-H. With this configuration, the vehicle lighting unit 10 can form the additional light distribution patterns PL and PR for illuminating only the left and right lateral areas AL and AR outside the angular area of ±9 degrees in the right and left directions above the horizontal line H-H with light while not illuminating the area between the left and right lateral areas AL and AR. If the front reflecting surfaces 26L and 26R are provided in areas inside the angular area of ±9 degrees in the right and left directions, the light reflected by the same may become glare to oncoming vehicles or preceding vehicles. With the above configuration of the presently disclosed subject matter, the generation of glare can be prevented. (According to ECE regulation, it is required to prohibit the generation of glare inside the angular area of ±9 degrees in the right and left directions.)

The rear reflecting surface 28 can have a straight vertical cross section (see FIGS. 6A and 6B) and a curved horizontal cross section along the upper edge 24*a* (see FIG. 5 and FIG. 8). The rear reflecting surface 28 can be formed by subjecting the upper surface of the rear extending portion 24*c* of the shade 18, which extends from the upper edge 24*a* rearward and obliquely downward, to mirror finishing or metal deposition such as aluminum deposition. Alternatively, a thin reflective plate can be pasted onto the upper surface of the rear extending portion 24*c* of the shade 18. Note that the rear reflecting surface 28 can have a curved vertical cross section other than the straight vertical cross section.

As shown in FIG. 6A, the inclination angle θ2 of the rear reflecting surface 28 with respect to the horizontal plane can be set to an angle of α/2 or larger (where α represents the angular range α of light incident on the projector lens 12 as defined above) in order not to hinder the traveling path of light emitted from the light source 14 in all directions and incident on the projector lens 12 (see the light Ray3 in FIGS. 10A and 10B, which is the light reflected by part of the basic reflecting area 16*a* above the optical axis AX). Specifically, the rear reflecting surface 28 can be configured to extend rearward and obliquely downward in an area below and out of the area corresponding to the angular range α of the light incident on the projector lens 12.

In the vehicle lighting unit 10 with the above configuration, the light emitted from the light source 14 in all possible directions may include light incident on the rear reflecting surface 28 from all possible directions, for example, the light Ray4 reflected by the basic reflecting area 16*a* above the optical axis AX and incident on the rear reflecting surface 28 with a relatively small incident angle. The light can be reflected by the rear reflecting surface 28 and then pass through the projector lens 12 while being refracted by the same, thereby being directed toward the road surface. Specifically, the light can be turned back at the upper edge 24*a* (cut-off line CL) and can be overlaid on the basic light distribution pattern P1 below the cut-off line CL. Therefore, this configuration can enhance the light utilization efficiency of the vehicle lighting unit 10.

The inner reflecting surface 30 can be provided in an area so that the light reflected from the inner reflecting surface 30 is projected within the overhead sign area (for example, an angular area of ±9 degrees in the right and left directions and of 0 to 4 degrees above the horizontal line H-H). The inner reflecting surface 30 can have a straight vertical cross section (see FIG. 6A) and a concavely curved horizontal cross section (see FIG. 9). The rear reflecting surface 28 can be formed by subjecting the lower surface of the rear extending portion 24*c* of the shade 18, which extends from the upper edge 24*a* rearward and obliquely downward, to mirror finishing or metal deposition such as aluminum deposition. Alternatively, a thin reflective plate can be pasted onto the lower surface of the rear extending portion 24*c* of the shade 18. Note that the inner reflecting surface 30 can have a curved vertical cross section other than the straight vertical cross section.

As described above, since the inner reflecting surface 30 can be configured to be formed with a concavely curved horizontal cross section, the rear extending portion 24*c* of the shade 18 can be configured to have a thin center portion and thick end portions (both ends in the left and right directions in FIG. 8) which is a structure easy to be molded. Specifically, the concavely curved horizontal cross section of the inner reflecting surface 30 can maintain the strength of the rear extending portion 24*c* of the shade 18 while the overhead light distribution pattern P2 for illuminating the overhead sign area $A_{OH}$ with light can be formed.

In the vehicle lighting unit 10 with the above configuration, the light emitted from the light source 14 in all possible directions may include light reflected by the extension reflecting area 16*b* of the reflecting surfaces 16 and incident on the inner reflecting surface 30, for example, the light Ray5 shown in FIG. 6B. The light Ray5 can be reflected by the inner reflecting surface 30 and pass through the through hole 24*d* formed in part of the shade main body 24 (see FIGS. 6B and 9). Then, the light can pass through the projector lens 12 while being refracted, to be projected forward and obliquely upward. In this manner, the overhead light distribution pattern P2 for illuminating the overhead sign area $A_{OH}$ with light can be formed (see FIG. 11).

Note that the light Ray5 in FIG. 6A out of light reflected by the extension reflecting area 16*b* of the reflecting surface 16 can travel below and outside the angular range α of light incident on the projector lens 12. Therefore, the light Ray5 essentially may not be incident on the projector lens 12 without any directing means, and may not contribute for the formation of the basic light distribution pattern P1.

On the contrary, the inner reflecting surface 30 with the above configuration can reflect the light Ray5 in FIG. 6A out of the light reflected by the extension reflecting area 16*b* of the reflecting surfaces 16, thereby allowing the light Ray5 to pass through the through hole 24*d* formed in part of the shade main body 24 and to be incident on the projector lens 12. In this manner, the overhead light distribution pattern P2 for illuminating the overhead sign area $A_{OH}$ with light can be formed by the light passing through the projector lens 12 and refracted by the same (see FIG. 11). Therefore, this configuration can enhance the light utilization efficiency of the vehicle lighting unit 10.

As discussed above, the vehicle lighting unit 10 with the above configuration can be configured such that as shown in FIG. 6A the light emitted from the light source 14 in all directions can be reflected by the reflecting surface 16 (the basic reflecting area 16*a*) and be converged at or near (i.e., substantially at) the rear-side focal point F of the projector lens 12 without shielding by the front reflecting surfaces 26L and 26R and the rear reflecting surface 28. On the other hand, the shade 18 can shield the part of the light emitted from the light source 14 and reflected by the reflecting surface 16, the part of the light assumed to be directed upward and pass through the projector lens 12 if it is not shielded. The resulting light, having passed through the projector lens 12, can form the basic light distribution pattern P1 (low-beam light distribution pattern) including the cut-off line CL defined by the upper edge 24*a* of the shade 18 on a virtual vertical screen assumed to be disposed in front of a vehicle body about 25 m away from the vehicle body.

To the basic light distribution pattern P1 (low-beam light distribution pattern), the additional light distribution patterns PL and PR formed by the light reflected by the front reflecting surfaces 26L and 26R and the overhead light distribution pattern P2 formed by the light reflected by the extension reflecting area 16*b* and inner reflecting surface 30 (twice reflection) can be added (see FIG. 11).

As described above, the vehicle lighting unit 10 of the present exemplary embodiment can include the front reflecting surfaces 26L and 26R extending from both the horizontal end portions 24*a*L and 24*a*R of the upper edge 24*a* forward and obliquely downward. The light emitted from the light source 14 in all possible directions may include light incident on the front reflecting surfaces 26L and 26R from all possible directions, for example, the light Ray2 reflected by the reflecting surface 16 above the optical axis AX and incident on the front reflecting surfaces 26L and 26R with a relatively large incident angle. This light Ray2 can be reflected by the front reflecting surfaces 26L and 26R so as to pass through the projector lens 12. Thereby, the additional light distribution patterns PL and PR for illuminating the left and right lateral areas AL and AR above the horizontal line H-H but not for illuminating the area between the left and right lateral areas AL and AR can be added to the low-beam light distribution pattern P including the cut-off line CL defined by the upper edge 24*a* of the shade 18. Note that there is no front reflecting surface between the front reflecting surfaces 26L and 26R, and thus, the area between the left and right lateral areas AL and AR is not illuminated with light.

Furthermore, the vehicle lighting unit 10 of the present exemplary embodiment can add the additional light distribution patterns PL and PR for illuminating the left and right lateral areas AL and AR above the horizontal line H-H but not for illuminating the area between the left and right lateral areas AL and AR. Therefore, the vehicle lighting unit 10 is capable of illuminating pedestrians, hindrances and the like present in the left and right lateral areas AL and AR above the horizontal line H-H with light while suppressing the generation of glare to oncoming vehicles or preceding vehicles.

The light incident on the front reflecting surfaces 26L and 26R with a relatively large incident angle, for example, the light Ray2 shown in FIG. 10B, may not originally contribute to the formation of the light distribution because it may not be incident on the projector lens 12 as described by the dotted line in FIG. 10B. The vehicle lighting unit 10 of the present exemplary embodiment, however, can cause the light Ray2 to be reflected by the front reflecting surfaces 26L and 26R and to pass through the projector lens 12, thereby utilizing the light Ray2 for the formation of the additional light distribution patterns PL and PR. This configuration can enhance the light utilization efficiency of the vehicle lighting unit 10.

The light emitted from the light source 14 in all possible directions may include light incident on the rear reflecting surface 28 from all possible directions, for example, the light Ray4 reflected by the reflecting surface 16 above the optical axis AX and incident on the rear reflecting surface 28 with a relatively small incident angle. In the vehicle lighting unit 10 of the present exemplary embodiment, this light Ray4 can be reflected by the rear reflecting surface 28 so as to pass through the projector lens 12. Therefore, this configuration can enhance the light utilization efficiency of the vehicle lighting unit 10.

Furthermore, the vehicle lighting unit 10 of the present exemplary embodiment can be configured such that part of the light emitted from the light source 14 is not reflected by the basic reflecting area 16*a* (corresponding to the reflecting area for reflecting light for forming the conventional basic light distribution pattern), but can be reflected by the extension reflecting area 16*b* of the reflecting surface 16 and further reflected by the inner reflecting surface 30, wherein the extension reflecting area 16*b* can be configured to extend below and out of the area 16*a* corresponding to the angular range α of light incident on the projector lens 12. The light reflected twice can pass through the through hole 24*d* formed in part of the upper end portion of the shade main body 24, and be incident on the projector lens to pass through the projector lens 12, thereby forming the overhead light distribution pattern P2 for illuminating the overhead sign area $A_{OH}$ with light on the virtual vertical screen assumed to be disposed in front of a vehicle body. Accordingly, the vehicle lighting unit 10 is capable of forming both the basic light distribution pattern P1 and the overhead light distribution pattern P2 without invading the area (basic reflecting area 16*a*) for reflecting light for forming the basic light distribution pattern P1.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit having an optical axis extending in a front-to-rear direction of a vehicle body, the vehicle lighting unit comprising:

a projector lens disposed on the optical axis and having a rear-side focal point;

a light source disposed behind the rear-side focal point of the projector lens;

a reflecting surface configured to reflect light emitted from the light source forward so that the light is directed toward the optical axis; and a shade disposed between the projector lens and the light source, the shade configured to shield part of the light emitted from the light source and reflected by the reflecting surface, the part of the light being light that is directed upward and is prevented from passing through the projector lens by the shade, the vehicle lighting unit configured to form a low-beam light distribution pattern including a cut-off line defined by the shade, wherein:

the light source is configured to emit light in all possible directions around the light source as a center;

the shade includes a shade main body having an upper edge disposed substantially at the rear-side focal point of the projector lens and extending substantially horizontally along a focal point plane of the projector lens, and front extending portions extending from both horizontal end portions of the upper edge forward and obliquely downward, the front extending portions being configured to include, on respective upper surfaces thereof, front reflecting surfaces configured to reflect forward light emitted from the light source and entering the front reflecting surfaces so that the reflected light is allowed to pass through the projector lens and is used for illuminating left and right lateral areas above the horizontal line on a virtual vertical screen in front of the vehicle body, thereby forming additional light distribution patterns to be added to the low-beam light distribution pattern; and the front reflecting surfaces have a curved horizontal cross section along the upper edge and are provided not in the center of the upper edge but in horizontal end areas with respect to the optical axis so that the additional light distribution patterns are positioned outside an angular area of ±9 degrees in the right and left directions above the horizontal line.

2. A vehicle lighting unit having an optical axis extending in a front-to-rear direction of a vehicle body, the vehicle lighting unit comprising:

a projector lens disposed on the optical axis and having a rear-side focal point;

a light source disposed behind the rear-side focal point of the projector lens;

a reflecting surface configured to reflect light emitted from the light source forward so that the light is directed toward the optical axis; and a shade disposed between the projector lens and the light source, the shade configured to shield part of the light emitted from the light source and reflected by the reflecting surface, the part of the light being light that is directed upward and is prevented from passing through the projector lens by the shade, the vehicle lighting unit configured to form light distribution pattern including a cut-off line defined b the shade, wherein:

the light source is configured to emit light in all possible directions around the light source as a center;

the shade includes a shade main body having an upper edge disposed substantially at the rear-side focal point of the projector lens and extending substantially horizontally along a focal point plane of the projector lens, and front extending portions extending from both horizontal end portions of the upper edge forward and obliquely downward, the front extending portions being configured to include, on respective upper surfaces thereof, front reflecting surfaces configured to reflect forward light emitted from the light source and entering the front reflecting surfaces so that the reflected light is allowed to pass through the projector lens and is used for illuminating left and right lateral areas above the horizontal line on a virtual vertical screen in front of the vehicle body, thereby forming additional light distribution patterns to be added to the low-beam light distribution pattern; and the shade further includes a rear extending portion extending from the upper edge rearward and obliquely downward, the rear extending portion including a rear reflecting surface on an upper surface thereof, the rear reflecting surface being configured to reflect forward light emitted from the light source and entering the rear reflecting surface so that the reflected light is allowed to pass through the projector lens.

3. A vehicle lighting unit having an optical axis extending in a front-to-rear direction of a vehicle body, the vehicle lighting unit comprising:

a projector lens disposed on the optical axis and having a rear-side focal point;

a light source disposed behind the rear-side focal point of the projector lens;

a reflecting surface configured to reflect light emitted from the light source forward so that the light is directed toward the optical axis; and a shade disposed between the projector lens and the light source, the shade configured to shield part of the light emitted from the light source and reflected by the reflecting surface, the part of the light being light that is directed upward and is prevented from passing through the projector lens by the shade, the vehicle lighting unit configured to form a low-beam light distribution pattern including a cut-off line defined by the shade, wherein the light source is configured to emit light in all possible directions around the light source as a center, the reflecting surface includes a basic reflecting area corresponding to an angular range of light incident on the projector lens and an extension reflecting area extending below and out of the area corresponding to the angular range, the shade includes a shade main body having an upper edge disposed substantially at the rear-side focal point of the projector lens and extending substantially horizontally along a focal point plane of the projector lens, and a rear extending portion extending from the upper edge rearward and obliquely downward, the rear extending portion including a rear reflecting surface on an upper surface thereof and an inner reflecting surface on a lower surface thereof, the shade main body includes a through hole formed in part of an upper end portion of the shade main body so that the light reflected by the extension reflecting area and further reflected by the inner reflecting surface is allowed to pass therethrough, the vehicle lighting unit is configured such that part of light emitted from the light source in all possible directions enters and is reflected by the extension reflecting area and is further reflected by the inner reflecting surface, and is allowed to pass through the through hole of the shade main body to be projected through the projector lens forward and obliquely upward so as to illuminate an overhead sign area on a virtual vertical screen in front of the vehicle body, thereby forming an overhead light distribution pattern, and the shade further includes front extending portions extending from both horizontal end portions of the upper edge forward and obliquely downward, the front extending portions being configured to include, on respective upper surfaces thereof, front reflecting surfaces configured to reflect forward the light emitted from the light source and entering the front reflecting surfaces so that the reflected light is allowed to pass through the projector lens and is used for illuminating left and right lateral areas above the horizontal line on the virtual vertical screen in front of the vehicle body, thereby forming additional light distribution patterns to be added to the basic light distribution pattern.

* * * * *